US005289519A

United States Patent [19]

Rand

[11] Patent Number: 5,289,519

[45] Date of Patent: * Feb. 22, 1994

[54] ROTATABLE ION CONTROLLING ELECTRODE ASSEMBLY WITH NO OFFSET OR DEFLECTION OF LOW ENERGY ELECTRONS FOR A SCANNING ELECTRON BEAM COMPUTED TOMOGRAPHY SCANNER

[75] Inventor: Roy E. Rand, Palo Alto, Calif.

[73] Assignee: Imatron, Inc., Calif.

[ * ] Notice: The portion of the term of this patent subsequent to Mar. 9, 2010 has been disclaimed.

[21] Appl. No.: 958,939

[22] Filed: Oct. 9, 1992

Related U.S. Application Data

[63] Continuation of Ser. No. 809,924, Dec. 18, 1991, Pat. No. 5,193,105.

[51] Int. Cl.[5] ..... H01J 35/06

[52] U.S. Cl. ..... 378/4; 378/131; 378/121; 250/396 ML

[58] Field of Search ..... 378/91, 101, 114, 121, 378/123, 137, 145, 119, 4, 113, 138; 250/396 ML, 396 R, 398

[56] References Cited

U.S. PATENT DOCUMENTS

| | | | |
|---|---|---|---|
| 4,007,375 | 2/1977 | Albert | 378/113 |
| 4,158,142 | 6/1979 | Haimson | 378/113 |
| 5,193,105 | 3/1993 | Rand et al. | 378/137 |

*Primary Examiner*—David P. Porta
*Assistant Examiner*—Don Wong
*Attorney, Agent, or Firm*—Flehr, Hohbach, Test, Albritton & Herbert

[57] ABSTRACT

An electron beam scanning system producing an electron beam in a relatively short chamber includes an ion controlling electrode assembly located between the electron gun and system beam optics. The assembly includes a somewhat cone-shaped rotating field ion controlling electrode ("RICE") unit disposed between first and second ion controlling electrode units ("ICE"s). The RICE and ICEs each comprise element pairs symmetrically disposed on opposite sides of the chamber Z-axis, preferably forming regular polygons in cross-section. Preferably corresponding elements in each ICE are electrically coupled to each other and to an opposite element in the RICE. Preferably equal and opposite bias potentials, with respect to an average potential, are coupled to the RICE and ICE elements comprising an element pair. Because it is somewhat cone-shaped, the RICE and electron beam create a transverse electric field with no axial component. Varying the bias potentials rotates the RICE electric field to controllably remove most but not all positive ions. The remaining ions improve the electron beam space-charge density, resulting in a sharply focused scanning electron beam. The ICE units sweep away positive ions in regions within the overall assembly not otherwise acted upon by fields. A single power source provides multiple potentials via a voltage divider, which potentials are switchably coupled to the RICE and ICE units to provide the required element potentials that may be controllably switched to rotate the resultant electric field in a predictable manner. The complete electrode assembly neither displaces nor deflects the emergent electron beam from the Z-axis.

24 Claims, 8 Drawing Sheets

SPACE-CHARGE DENSITY OF ORIGINAL BEAM

POTENTIAL DUE TO ORIGINAL BEAM

POTENTIAL WITH APPLIED ELECTRIC FIELD

SOLID LINE—NO NEUTRALIZATION

DASHED LINE—WITH ASSYMMETRIC NEUTRALIZATION

EFFECTIVE SPACE-CHARGE DENSITY OF PARTIALLY NEUTRALIZED BEAM

ROTATABLE ION CONTROLLING ELECTRODE ASSEMBLY WITH NO OFFSET OR DEFLECTION OF LOW ENERGY ELECTRONS FOR A SCANNING ELECTRON BEAM COMPUTED TOMOGRAPHY SCANNER

RELATIONSHIP TO PREVIOUSLY FILED APPLICATION

This application is a continuing application of application Ser. No. 07/809,924, filed Dec. 18, 1991, now U.S. Pat. No. 5,193,105 (Mar. 9, 1992).

FIELD OF THE INVENTION

The present invention relates generally to scanning electron beam systems for X-ray production in a computed tomography X-ray transmission system, and more particularly to controlling the uniformity of the beam space-charge density, especially by means of positive ions.

BACKGROUND OF THE INVENTION

Scanning electron beam computed tomography systems are described generally in U.S. Pat. No. 4,352,021 (Boyd, et al.) issued Sep. 28, 1982. The theory and implementation of devices to help control the electron beam in such systems is described in detail in U.S. Pat. No. 4,521,900 (Rand, et al.), issued Jun. 4, 1985; U.S. Pat. No. 4,521,901 (Rand, et al.) issued Jun. 4, 1985; U.S. Pat. No. 4,625,150 (Rand, et al.) issued Nov. 25, 1986; and U.S. Pat. No. 4,644,168 (Rand, et al.) issued Feb. 17, 1987. Applicants refer to and incorporate herein by reference each above listed patent to Rand, et al.

As described in detail in U.S. Pat. No. 4,521,900 to Rand, et al. (hereafter "Rand, et al. '900"), an electron beam is produced by an electron gun at the upstream end of an evacuated generally elongated and conical shaped housing chamber (or "drift tube"). A large electron gun potential (e.g., 130 kV) accelerates the electron beam downstream along a first straight line path defining the chamber Z-axis. Further downstream a beam optical system including focus and deflection coils deflects the beam into a scanning path. The deflected beam exits the beam optical system and impinges a suitable target for producing X-rays. The X-rays penetrate an object (e.g., a person) and are then detected and computer processed to produce an X-ray image of a portion of the object. Prior art electron beam systems such as described in the above-referenced patents characteristically had relatively long conical shaped housing chambers, e.g., 3.8 meters.

Because the electrons are negatively charged, the resultant space-charge causes the electron beam to diverge or expand in the upstream chamber region between the electron gun and the focus and deflection coils. This expansion is beneficial because the beam diameter at the target varies approximately inversely with the beam diameter at the focus and deflection coils. In the chamber region downstream from the focus and deflection coils, a converging electron beam is desired. In that downstream region, the beam preferably is neutralized by positive ions produced by the electrons from residual gas in the chamber, or from a gas purposely introduced into the chamber. This neutralization causes the beam to self-focus sharply upon the target to produce a sharp X-ray image. In the ideal case, the electron beam is perfectly uniform in current density, diverging upstream and converging to sharply self-focus downstream.

Although a diverging beam is desired in the upstream chamber region, positive ions can counteract divergence. Positive ions are present because the electron beam interacts with residual gases that inevitably remain after evacuation, or with gases purposely introduced into the chamber. In the upstream chamber region, positive ions are detrimental because they tend to neutralize the space-charge, preventing electron beam divergence. This in turn increases the beam width at the target, resulting in a defocused X-ray image. Neutralization also can result in the beam becoming unstable and collapsing completely.

By contrast, positive ion neutralization can be beneficial in the chamber region downstream from the focus-deflection coils. Here neutralization eliminates the electron self-repulsion, while the beam's attractive magnetic field converges and self-focuses the beam. Elements of the beam optical system are then used to fine tune the converged beam to produce a sharp X-ray image.

Thus, while positive ions can be beneficial downstream from the focus-deflection coils, they are detrimental in the upstream region. In prior art tomography systems such as described in the Rand, et al. Ser. No. 4,521,900 patent, positive ions were removed by causing the electron beam to pass axially through an electrically biased ion clearing electrode (or "ICE") mounted in the upstream chamber region. The ICE created a relatively large transverse electric field that swept away the slow moving positive ions, without disturbing the considerably faster moving electrons. Such ICEs required large electrode potentials (e.g., about 3 kV) to produce the large electric field needed to remove ions on an "all or nothing" basis.

Ideally the electron beam should be homogenous, i.e., with a uniform electron distribution, so the beam acts as its own perfect lens: self-diverging in the upstream chamber region and self-converging in the downstream chamber region to focus sharply on the target. A uniform space-charge density is desired because any optical aberrations due to the electron beam self-forces would then be eliminated. In addition to degradation from ions, the electron beam space-charge density may not be perfectly uniform due to imperfections in the electron gun and in the beam optics system.

It is believed that the relatively long length of prior art housing chambers contributed to beam space-charge homogenization by smoothing or evening out the electron distribution. In essence, the distance between the electron gun and beam optics was sufficiently long to allow the electron beam to expand and become more uniform without requiring special mechanisms to compensate for beam non-uniformity.

For reasons of economy, maintenance and ease of installation in hospitals, it is advantageous to construct a scanning electron beam system using a housing chamber shorter than used in prior art systems. Unfortunately, however, the resultant shorter distance between the electron gun and beam optics prevents the beam from expanding sufficiently to become homogeneous. Further, the construction of shorter housing chambers may create discontinuities, typically near vacuum valve couplings and flanges. These discontinuities create gaps in the electric field generated by ion controlling devices, thus allowing some ions to remain in the upstream region where they further degrade beam expansion.

While applicants, above referenced U.S. Pat. No. 5,193,105 discloses a suitable ion controlling electrode assembly, that assembly required several power supplies and thus did not provide a simple mechanism to rotate the electric field. Further, that assembly did not ensure cancellation of electron beam deflections and displacements regardless of field orientations.

In summary, in an electron beam scanner system employing a relatively short length housing chamber, there is a need for a method and apparatus for removing positive ions, and for controlling the positive ion distribution. Such method and apparatus should compensate for beam space-charge density non-uniformity, thereby eliminating any aberrations due to the beam self-forces. Preferably such method and apparatus should operate from relatively few power sources, should provide a straightforward mechanism for controllably rotating the electric field, and should ensure cancellation of electron beam deflections and displacements regardless of electric field orientation.

Unfortunately, prior art ICEs with their "all or nothing" characteristic simply do not provide any mechanism for controlling space-charge uniformity of the electron beam, and do not remove all ions when operating over discontinuities. The present invention discloses an ion controlling electrode assembly and a method to fulfil these needs.

SUMMARY OF THE INVENTION

The present invention is a relatively short length ion controlling electrode assembly for use in a short length housing chamber in a computed tomography X-ray transmission scanning system. Because the chamber is short, the electron beam cannot adequately expand between the electron gun and beam optics. Using relatively few power sources, the present invention provides an electrode assembly that compensates for this by controllably removing some (but not necessarily all) ions, thereby adjusting the electron beam's space-charge density distribution. In a preferred embodiment, a single rotary switches controllably rotates the electric field within the electrode assembly to improve beam spot resolution and thus image sharpness.

The electrode assembly is disposed within the vacuum housing chamber between the electron gun and the focus-deflection coils such that the electron beam passes axially through the electrode assembly along the Z-axis. The electrode assembly includes a rotatable field ion controlling electrode ("RICE"), ion clearing electrodes ("ICEs") located on either side of the RICE and, downstream therefrom, a positive ion electrode ("PIE"). An alternative embodiment further includes an optional periodic axial field ion controlling electrode ("PICE"), located at the most upstream region of the electrode assembly.

The RICE improves image sharpness by homogenizing the electron beam space-charge density, thereby linearizing the beam optics and eliminating aberrations. Some but not necessarily all positive ions are controllably removed by subjecting the electron beam to a small, rotatable transverse electric field generated by the RICE. The field is preferably on the same order of magnitude as the field created by the electron beam, and is rotated by varying the electrical potential coupled to the elements comprising the RICE. The electric field is adjusted until the electron beam space-charge density is homogenized, and so the scanner system's X-ray image exhibits maximum resolution or sharpness.

The RICE preferably includes at least three pair of spaced-apart elements, an equal and opposite electrical potential, with respect to an average potential, preferably being coupled to each element in an element pair. In cross-section, the RICE preferably forms a regular polygon, with the elements comprising each element pair preferably being symmetrical to each other about the Z-axis. Overall, the RICE shape preferably approximates a cone that expands downstream such that the distance from the Z-axis to each RICE element is approximately proportional to the electron beam radius at each point. This geometry tends to make the potential along the beam's Z-axis constant. As a result, positive ions trapped within the electron beam tend not to drift axially along the Z-axis, which drift could produce severe beam optical aberrations.

The potential applied to a RICE element may be AC, DC or a combination thereof and preferably is readily varied to control and rotate the RICE electric field. Because a potential difference exists between the RICE elements, a transverse electric field is created. If the RICE electrode potentials are DC, the resultant RICE transverse field will be static, but if an AC electrode potential is present, a dynamic or rotating field mode occurs. By varying the electrode potentials, the RICE field can be rotated to control how many positive ions, if any, are allowed to remain within the RICE to modify and improve the beam space-charge uniformity. The resultant more homogenized space-charge density reduces (or eliminates) aberrations due to the electron beam, allowing for easier focusing by the scanning system's beam optical components.

Preferably the electrode potentials are varied using a rotary switch coupled through a voltage divider network to a single power source. As will be described, preferably each RICE element is coupled to an opposite element in similarly configured ion clearing electrodes ("ICEs"). As the switch is rotated, equal and opposite potentials, with respect to an average potential, are applied to opposing elements in each RICE and ICE electrode. By applying potentials to the ICE elements that are 180° out of phase with the potentials applied to the corresponding RICE element, the present invention ensures that the electron beam emerges from the electrode assembly on axis. This in turn simplifies design of the subsequent beam optics. Thus, rotation of the switch simultaneously changes the potential coupled to each ICE and RICE element, permitting the electric field to be discretely rotated by known angular displacements.

In yet another aspect, the present invention further includes first and second ion clearing electrodes (ICEs), preferably coaxially disposed immediately upstream and downstream from the RICE. Preferably each ICE includes at least three pair of spaced-apart elements that form, in cross-section, a regular polygon, with the elements comprising each element pair symmetrical to each other about the Z-axis. Preferably each element in the first and second ICE is electrically coupled to an equal and opposite potential, and to an opposite element in the RICE. So coupled, the ICEs sweep away all positive ions on either side of the RICE, while deflections and displacements of the electron beam by the first ICE, the RICE, and the second ICE cancel, ensuring that the electron beam emerges from the electrode assembly on-axis. The ICEs allow control over the electric field in any region of the housing chamber between the electron gun and beam optics not otherwise controlled by the RICE, or as described below, the PIE and, if present, PICE electrodes.

Preferably the electrode assembly further includes a positive ion electrode ("PIE") disposed coaxially downstream from the RICE and second ICE. The PIE is biased to create a large axial field that prevents upstream migration of positive ions, which migration could interfere with the production of a sharply self-focused uniform beam at the X-ray target.

The present invention preferably further includes a short-length periodic axial field ion controlling electrode ("PICE"). The PICE is located adjacent the electron gun, in the upstream region of the housing chamber where small size and discontinuities preclude the effective use of a conventional ICE. The PICE comprises several spaced-apart washer-like electrodes coaxial to the Z-axis, with alternate electrodes coupled to a relatively large potential (e.g., −1 kV) relative to intermediate electrodes (e.g., 0V). The PICE's small size allows it to operate in the upstream housing chamber region across discontinuities and thus remove positive ions from this region.

In summary, the present invention controls the ion distribution density within an electron beam by rotating the vector direction and strength of a relatively low magnitude transverse field created by a RICE. A PIE prevents any upstream migration of positive ions into the RICE where they could interfere with RICE operation. A PICE removes ions from the upstream region of the chamber where discontinuities are present, and ICEs remove ions from regions of the chamber not controlled by the RICE, PIE or PICE. By suitably coupling ICE electrodes to a corresponding opposite electrode in the RICE, the deflection and displacement of the electron beam through the first ICE, the RICE and the second ICE are ensured to be zero. This configuration permits a single power source to be switchably coupled to the RICE and ICE elements to controllably rotate the resultant electric field through known degrees of displacement. The resultant electron beam produces a controllably sharper, higher resolution X-ray image.

Other features and advantages of the invention will appear from the following description in which the preferred embodiments have been set forth in detail in conjunction with the accompanying drawings.

DESCRIPTION OF THE PREFERRED EMBODIMENTS

Figure 1:
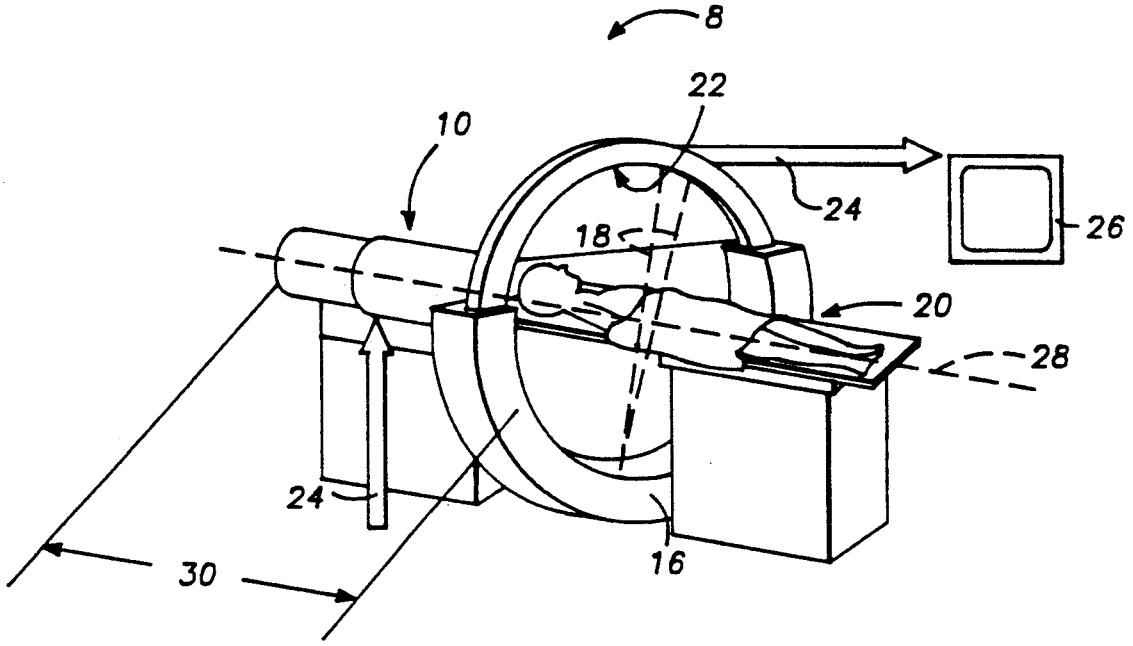
FIG. 1 depicts a generalized scanning computed tomography X-ray transmission system that uses a relatively short length vacuum housing chamber to produce and control an electron beam.
Figure 2:
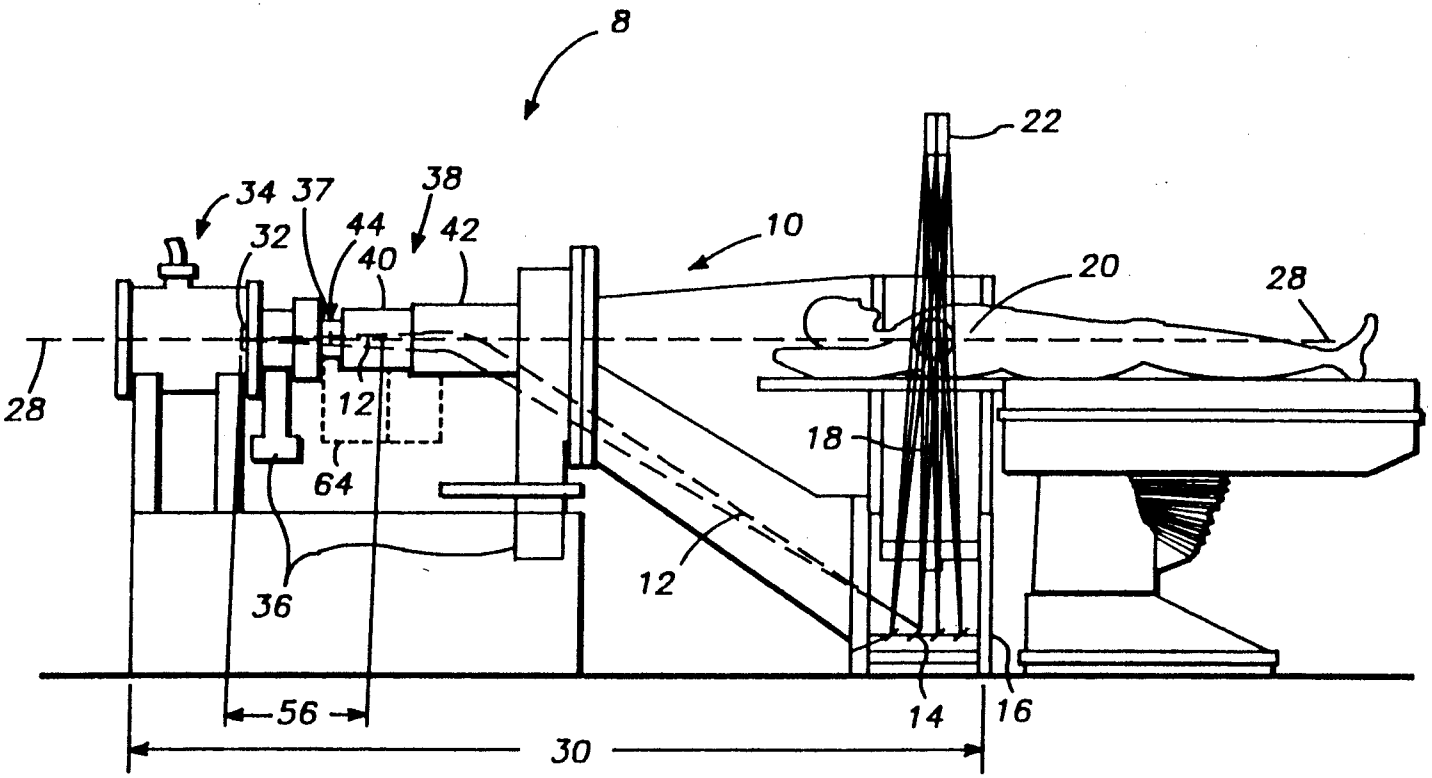
FIG. 2 is a longitudinal view of the system shown in FIG. 1.

FIG. 1 and FIG. 2 depict a generalized computed tomography X-ray transmission scanning system 8 that includes a relatively short length vacuum housing chamber 10 wherein an electron beam 12 is generated and caused to scan at least one circular target 14 located within chamber 12's front lower portion 16. When it strikes the target, the electron beam, which typically scans 210° or so, emits a moving fan-like beam of X-rays 18. X-rays 18 then pass through a region of a subject 20 (e.g., a patient or other object) and register upon a region of a detector array 22 located diametrically opposite. The detector array outputs data to a computer processing system (indicated by arrows 24) that processes and records the data to produce an image of a slice of the subject on a video monitor 26. As indicated by the second arrow 24, the computer processing system also controls the system 8 and the electron beam production therein. By repeating the scanning process after the patient has been moved laterally along the chamber Z-axis 28, a series of X-ray images representing axial "slices" of the patient's body is produced.

As shown in FIG. 2, an electron gun 32 within the extreme upstream end 34 of chamber 10 produces the electron beam 12 in response to high voltage excitation (e.g., 130 kV). Although vacuum pumps 36 evacuate chamber 10, residual gases inevitably remain that produce positive ions in the presence of the electron beam 12. Gases may also be introduced into the chamber for the purpose of producing positive ions, since the ions are beneficial in the downstream chamber region. A beam optical system 38 that includes a focus coil 40 and a deflection coil 42 is mounted downstream in chamber 10 to respectively magnetically focus and scan the beam 12 typically about 210° in an arc across an arc-like target 14.

The positive ions that are created can detrimentally neutralize the electron beam in the upstream region of chamber 10. It is important to subject the electron beam 12 to an electric field in the upstream region, but discontinuities such as 37 in the housing 10 create gaps over which conventional devices for clearing ions cannot be used. In addition, imperfections in the electron gun cause the electron beam to have a non-uniform space-charge density in a plane perpendicular to the Z-axis 28. Finally, because the drift distance between the electron gun and the beam optics 38 is relatively short, e.g., 40 cm or so, the electron beam 12 does not have time for its space-charge density to become sufficiently homogeneous. The present invention, electrode assembly 44, is designed to counteract these detriments and to ensure that the X-ray image resulting from the relatively short length computed tomography system 8 is sufficiently sharply focused and of high resolution. Assembly 44 must function within a relatively short chamber length 30, typically about 2.5 meters as contrasted with 3.8 meters for chamber lengths in scanning systems such as described in the Rand, et al. and Boyd, et al. references.

As shown in FIG. 2, electrode assembly 44 is mounted within housing 10 between the electron gun 32 and the beam optical assembly 38 such that the electron beam 12 passes axially through assembly 44 along the Z-axis 28. Ideally the Z-axis 28 is coaxial with the electron beam 12 upstream from the beam optics assembly 38 within chamber 10, and further represents the longitudinal axis of chamber 10, and the axis of symmetry for the electrode assembly 44 and the beam optics assembly 38.

Figure 3:
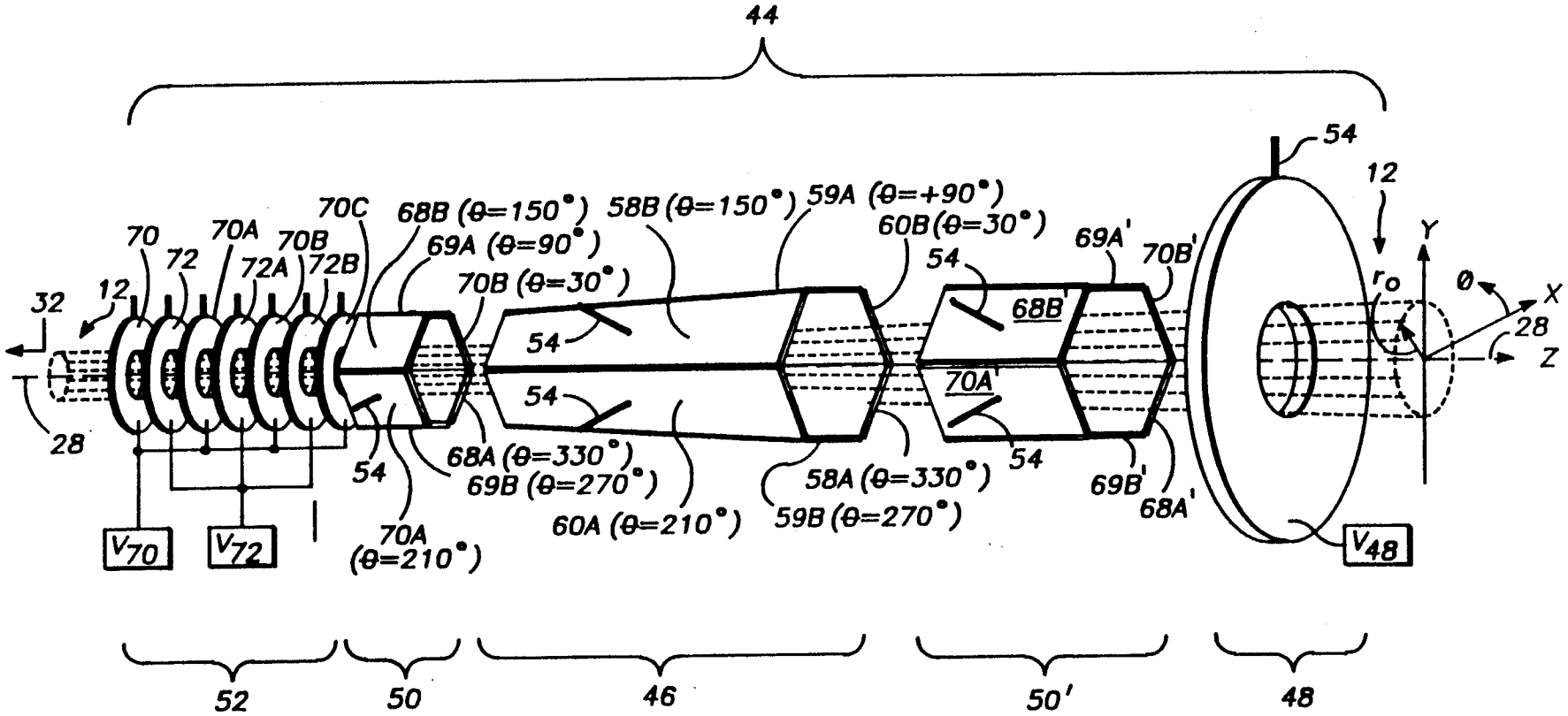
FIG. 3 is a perspective, expanded view of the ion electrode assembly shown in FIG. 2, according to the present invention.

As best seen in FIG. 3, a preferred embodiment of assembly 44 includes a rotatable field ion clearing electrode 46 ("RICE"), a positive ion electrode 48 ("PIE"), first and second ion clearing electrodes 50, 50' ("ICEs"), and a periodic axial field ion controlling electrode 52 ("PICE"). While FIG. 2 shows the present invention 44 used in conjunction with a relatively short housing 10, the present invention may also be used with conventional longer housings. Further, while FIG. 3 depicts assembly 44 as including a RICE, a PIE, two ICEs and a PICE, it is to be understood that the present invention may be implemented without all of these elements.

For example, the PICE 52 may be dispensed with where discontinuities are not present.

The various RICE, PIE, ICE and PICE elements comprising assembly 44 preferably are made from a relatively inert conducting material that does not outgas within chamber 10, stainless steel for example. Each RICE, PIE, ICE and PICE preferably is mounted within the chamber 10 using insulated standoffs 54, e.g., ceramic, as these elements are coupled to potential sources that create electric fields to which the electron beam 12 is subjected.

In the relatively short chamber system 8 with which the present invention may be used, the distance 56 from electron gun 32 to the focus coil 40 is only about 40 cm, contrasted with 1.5 m in the prior art systems with which the earlier Boyd, et al., Rand et al. patents were practiced. In these earlier systems, assembly 44 would have been a single prior art ICE, extending substantially the entire 1.5 meter distance from electron gun 32 to focus coil 40. In such systems, prior art ICEs would sweep away all ions, and the relatively large drift length allowed the electron beam space-charge density to become reasonably homogenous.

However in the present system 8, although approximately 40 cm distance is available for assembly 44, satisfactory performance is obtained with a RICE 46 whose length is about 18 cm. Rather than lengthen RICE 46 to the full electron gun-to-focus coil distance (40 cm) to control positive ions, positive ions are essentially totally removed from the otherwise exposed regions of chamber 10 using ICE elements 50, 50'. If, as depicted in FIG. 2, one or more discontinuities such as 37 are present, it is advantageous to include the PICE 52, a relatively short length element that can operate over such discontinuities.

The elements comprising the assembly 44 depicted in FIG. 3 will now be described in detail. According to the present invention, RICE 46 preferably creates a rotatable electric field to which the electron beam 12 is subjected, and represents the most important component of the electrode assembly 44. As shown in FIG. 3, overall RICE 46 is generally conical shaped and preferably includes at least three pair of elements 58A, 58B, 59A, 59B, 60A, and 60B. Preferably each of these elements is planar, and is spaced apart from its opposing element symmetrically about the Z-axis 28, thus causing RICE 46 to form a regular polygon in cross-section along the Z-axis. While for ease of manufacture these elements are planar, in fact they need not be planar and could, for example, be curved. While a RICE comprising more than three element pairs could be employed to improve the electric field uniformity, additional elements increase the difficulty in routing the many electrode potentials to the RICE.

Figures 4A, 4B, 4C, 4D:
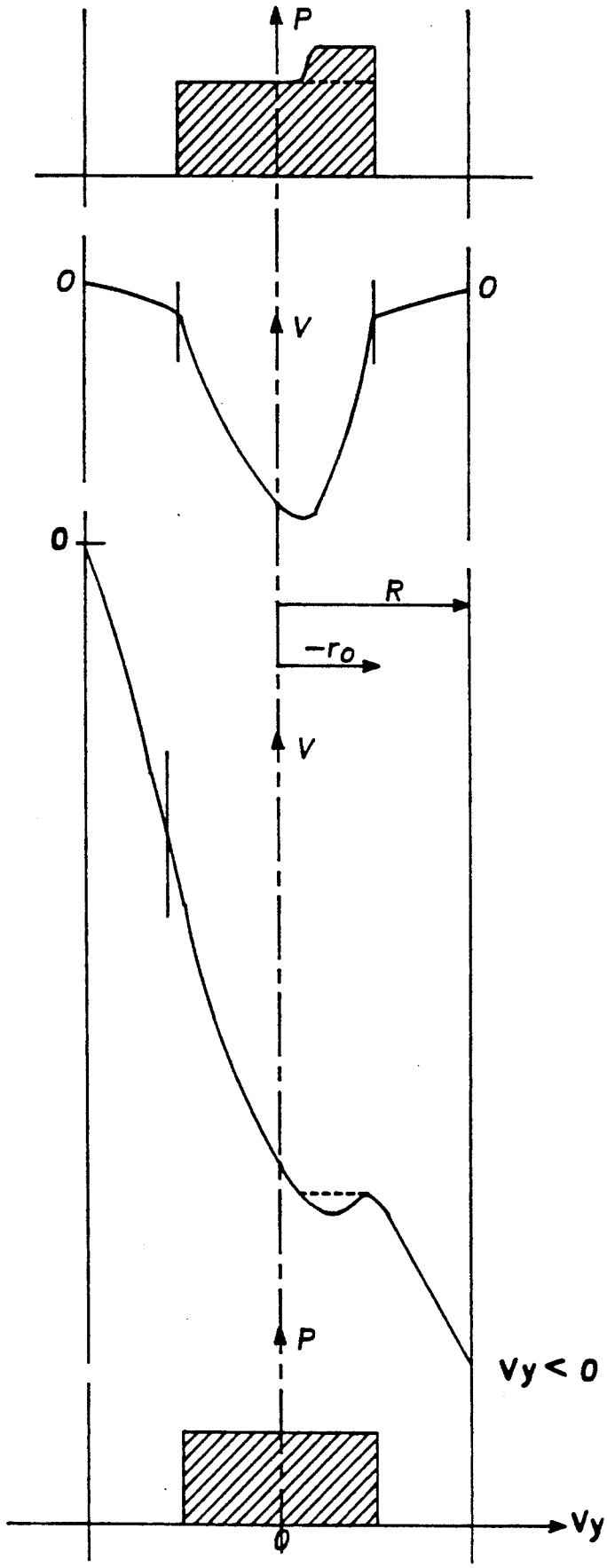
FIGS. 4A–4D depict correction of beam space-charge density resulting from an applied external corrective field created by a RICE, according to the present invention.

With reference to FIG. 3, RICE 46 is preferably conical shaped such that the ratio between the electrode radius (R) and the beam radius $r_o$ is constant. The generally conical geometry is significant because if $R/r_o \approx$ constant, then the electrical potential at the electron beam 12 axis is essentially constant. This means that positive ions trapped within the beam 12 will not drift axially, downstream or upstream. If this drift were not eliminated, positive ions within the beam would oscillate radially as they drifted, creating a severe non-uniform space-charge distribution, and beam optical aberrations. Since the electron beam 12 expands in the region in which the ion electrode assembly 44 or 44' is located, the RICE assembly 46, 46' has a generally cone shape that expands in the downstream direction. In the embodiment of FIG. 4A and 4B, the RICE length is approximately 18 cm, and the slope angle $\alpha$ is approximately 3°. The upstream RICE diameter is approximately 4 cm, while the larger downstream RICE diameter is approximately 6 cm.

Each element in an element pair comprising the generally conical shaped RICE 46 is coupled to a source of electrical potential, AC, DC or a combination thereof, that is preferably equal and opposite (with respect to an average potential) to the potential applied to the other element in the element pair. Further, as will be described, it is preferred that each element in the RICE 46 be electrically coupled to opposite electrodes in the ICE units 50 and 50'. The potential differences between elements in the RICE creates a uniform transverse electric field, whose amplitude and direction are rotatable by varying one or more potentials applied to the RICE element pairs. Of course changing the RICE geometry mechanically also would affect the resultant electric field, but modifying the geometry in situ to get a sharply focused X-ray image would be more difficult.

Regardless of how many electrode pairs a RICE comprises, several characteristics will preferably be present. The RICE will be generally conically shaped such that Z-axis potential differences within the electron beam are preferably minimized. The RICE will further exhibit symmetry about the Z-axis, the better to present a more uniform field to the electron beam 12. Preferably equal and opposite potentials (with respect to an average potential) will be coupled to each element comprising a RICE element pair, to present a more uniform field to the electron beam 12. A constant bias potential may also be applied to all electrodes to adjust the average potential.

The potential applied to the electrodes is preferably computed geometrically as follows. If $V_y$ represents the electrode electrical potential at the extreme Y-axis electrode position, then the potentials of the other electrodes take the general form:

$$V_i = V_y \times 0.5 \times (1 + \sin\theta_i) \quad (1)$$

where $\theta_i$ is the average angle of electrode i, e.g., $\theta_i = 90°$ for element 59A, $\theta_i = 270°$ for element 59B, and so forth. An electrode biasing scheme according to equation (1) will produce the most uniform electric field for a given number of electrodes. With reference to equation (1), and the configuration of FIG. 3, equation (1) requires that the potentials applied to RICE elements have the values shown in Table 1, following. Electrode potentials for a RICE comprising a different number of electrode pairs would be similarly calculated using equation (1), above.

TABLE 1

| Element | ≈ θ | Potential to Element |
|---|---|---|
| 58A | 330° | $0.25 \cdot V_y$ |
| 58B | 150° | $0.75 \cdot V_y$ |
| 59A | 90° | $V_y$ |
| 59B | 270° | 0 |
| 60A | 210° | $0.25 \cdot V_y$ |
| 60B | 30° | $0.75 \cdot V_y$ |

The electric field produced by this arrangement is approximately given by:

$$E = \frac{V_y}{2 \times R} \tag{2}$$

where R is the electrode radius measured from the Z-axis. The vector orientation of the electric field E is effectively in the direction of the y-axis, but other orientations may be obtained by rotating the y-axis.

As noted, by driving the RICE electrodes with DC potential, a static field having a desired magnitude and direction may be provided. However by driving the electrodes with AC potentials (or a DC potential including an AC component), a dynamically rotatable electric field may be created. In addition to the above potentials, a constant negative potential may be applied to all electrodes without affecting the RICE-produced electric fields.

The method of improving beam space-charge density using a controllable RICE transverse field will now be described. FIG. 4A depicts a hypothetical non-uniform space-charge distribution (ρ) for an electron beam having radius $r_o$ that is coaxial with RICE electrode member pairs having a radius R (e.g., the electrode pairs of FIG. 3, for example), for the case of non-uniformity in the direction of the y-axis. The distribution depicted in FIG. 4A is non-uniform in that a pedestal exists, the right side of the beam showing higher space-charge density than the left side. This non-uniformity could result from positive ions, from non-linear effects caused by the beam optics assembly 38, or from other causes. By contrast, a uniform distribution is shown in phantom in FIG. 4A, representing the ideal case.

A design goal of the present invention is for system 8 to produce an electron beam 12 whose space-charge density has improved uniformity, If the intrinsic space-charge density for the electron beam is as shown in FIG. 4A, then the present invention should reduce the excess space-charge density on the right side of the beam. A more uniform beam space-charge density (e.g., a space-charge density distribution approaching the distribution shown in phantom in FIG. 5A) reduces aberrations that would impair resolution of the X-ray image seen on monitor 26.

FIG. 4B depicts the potential (V) distribution across the electron beam due to the electron beam alone, and external to the beam but within the surrounding electrode. As such, FIG. 4B corresponds to the distribution of FIG. 4A and represents the potential that would be detected by a suitable probe monitoring the region encompassed by a RICE 46, or 46' according to the present invention, with no voltage applied to the electrodes.

Within a uniform electron beam, the potential (V) distribution of FIG. 4B would be given by the equation:

$$V = -\frac{\eta_o I}{\beta} \times \left[1 - \left(\frac{r}{r_o}\right)^2 + 2 \times \ln \frac{R}{r_o}\right] \tag{3}$$

where $$\eta_o = \frac{1}{4 \times \pi \times \epsilon_o \times c} \approx 30\Omega$$

and where I is the beam current, and β is the speed of the electrons divided by the speed of light.

Taking the first derivative of equation (3) with respect to radial distance r yields the electric field due to the beam, (E) as follows:

$$E = \frac{2\eta_o I}{\beta} \times \frac{r}{r_o^2} \tag{4}$$

The electric potential (V) according to equation (3) is symmetrical with respect to distance r, but the effect of the space-charge non-uniformity is to skew the potential distribution as shown in FIG. 4B.

A RICE according to the present invention modifies the skewed potential distribution by imposing a transverse electric field ($E_{correction}$) on the electron beam. This field is rotated (preferably by adjusting potentials to the elements comprising the RICE) until $E_{correction}$ is in the direction of the non-uniformity. The magnitude of the rotatable field is approximately:

$$E_{correction} \approx \frac{2\eta_o I}{\beta r_o}$$

$E_{correction}$ produces a potential (V) distribution across the electron beam and RICE electrodes as shown in FIG. 4C, with a shallow minimum (or potential well) on the right side of the beam. Because the positive ions in chamber 10 have a potential energy less than the potential well depth shown in FIG. 4C, the ions tend to accumulate and remain trapped in the well until electrostatic equilibrium is reached. The potential then follows the phantom or dashed line drawn in FIG. 4C. Thus positive ions trapped in the potential well reduce the effective space-charge density on the right side of the electron beam, which is precisely the correction needed to flatten out the non-uniform distribution of FIG. 4A. The net result is an electron beam with a more uniform space-charge distribution, as shown in FIG. 4D. Thus, aberrations due to an electron beam space-charge density corresponding to FIG. 4A are corrected. In general, correction of the space-charge distribution may not always be as exact as shown in FIG. 4. However aberrations due to a non-uniform distribution can always be reduced using a RICE, according to the present invention.

In practice, the field $E_{correction}$ required to homogenize an electron beam can be readily provided, about 60 V/cm being required to homogenize an electron beam having a 1 cm radius, 600 mA beam current, 130 kV electron gun potential, where $\beta \approx 0.6$. The resultant RICE field is approximately the same order of magnitude as the field produced by the electron beam itself, as contrasted with the extremely large field produced by a prior art ICE. A system 10 equipped with an electrode assembly 44 according to the present invention can produce an electron beam whose radius ($r_o$) is about 2 mm at the electron gun 32 and about 1 cm at the focus coil 40. At the target 14, the beam 12 is preferably sharply focused into an ellipse whose minor axis is about 1 mm or less, and whose major axis is about five to ten times larger.

As noted, the potentials applied to the elements in a RICE may be DC, AC or a combination thereof. Starting point values for $V_y$ for the RICE embodiment of FIG. 3 tend to be between about −300V to about −600V, which is substantially lower than the potentials required by a conventional prior art ICE. The $V_y$ voltage and field orientations are adjusted so that the highest resolution X-ray image is achieved. In some applications (e.g., system 8), operation of the RICE in a dynamic mode may be desirable. In this mode, the RICE element potentials preferably include an AC component synchronized to the signal that drives the beam optics 38. This dynamic mode is indicated by the phantom line 64 in FIG. 2. A statically driven RICE according to the present invention can produce a satisfactory beam distribution and resultant X-ray image for system 8. However, dynamically driving the RICE can provide corrections that vary the magnitude and direction of $E_{correction}$ to account for the scanning electron beam and the fact that optimal aberration correction may be a function of the direction of beam deflection.

FIG. 3 further depicts assembly 44 as including optional ICE elements 50, 50′ that function somewhat similarly to what is disclosed in U.S. Pat. No. 4,625,150 to Rand, et al., to sweep away ions while maintaining a uniform electric field. Each ICE 50, 50′ preferably comprises three separate element pairs, which collectively, in cross-section, form a constant radius polygon. ICE 50 comprises diametrically opposing element pairs 68A-68B, 69A-69B, and 70A-70B, and in similar fashion, ICE 50′ comprises elements 68A′-68B′, 69A′-69B′, and 70A′-70B′. In the preferred embodiment of FIG. 3, ICE 50 is about 4.5 cm in length and 2.5 cm in diameter, and ICE 50′ is about 9 cm in length and 5 cm in diameter, although different dimensions could be used.

Preferably ICE 50 and ICE 50′ each include as many pairs of opposing elements as does RICE 46, for example three pairs in the embodiment of FIG. 3. Further, it is preferred that the various ICE and RICE elements be similarly oriented. For example, RICE 46 elements 59A and 59B are oriented, respectively at 90° and 270°, as are ICE 50 elements 69A and 69B, and I-CE 50′ elements 69A′ and 69B′.

Figure 5A:
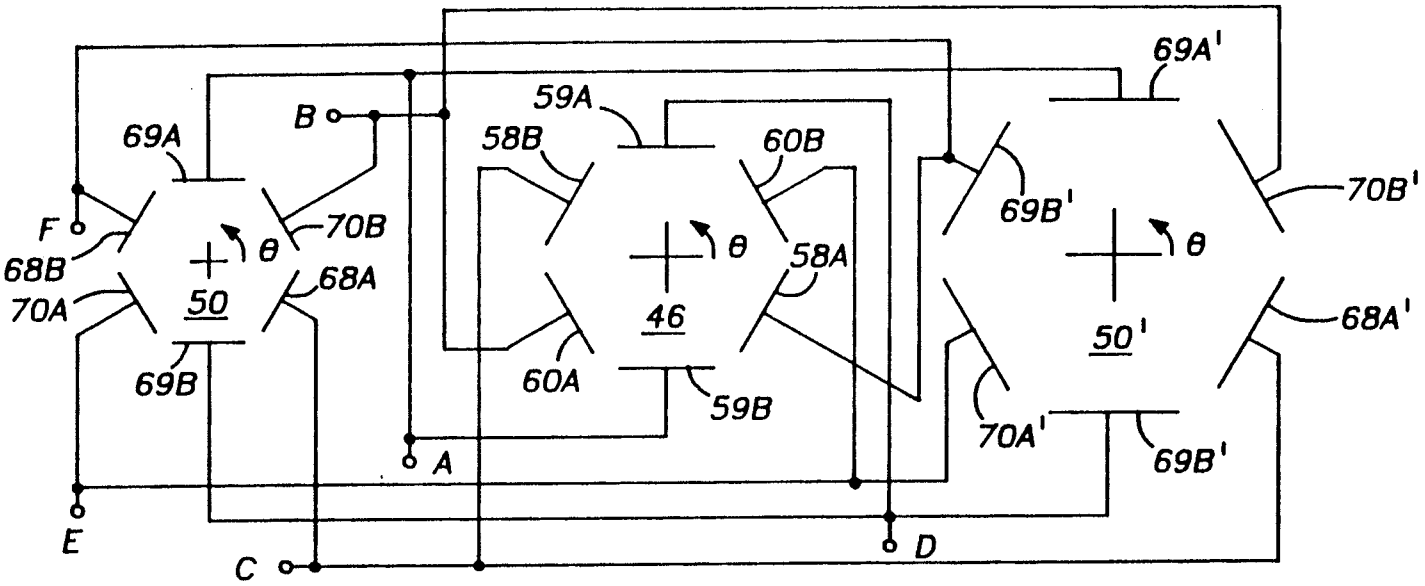
FIGS. 5A and 5B depict a preferred mechanism for coupling bias potentials to the RICE and ICE elements to facilitate electric field rotation and to ensure that the emerging electron beam is on axis.
Figure 5B:
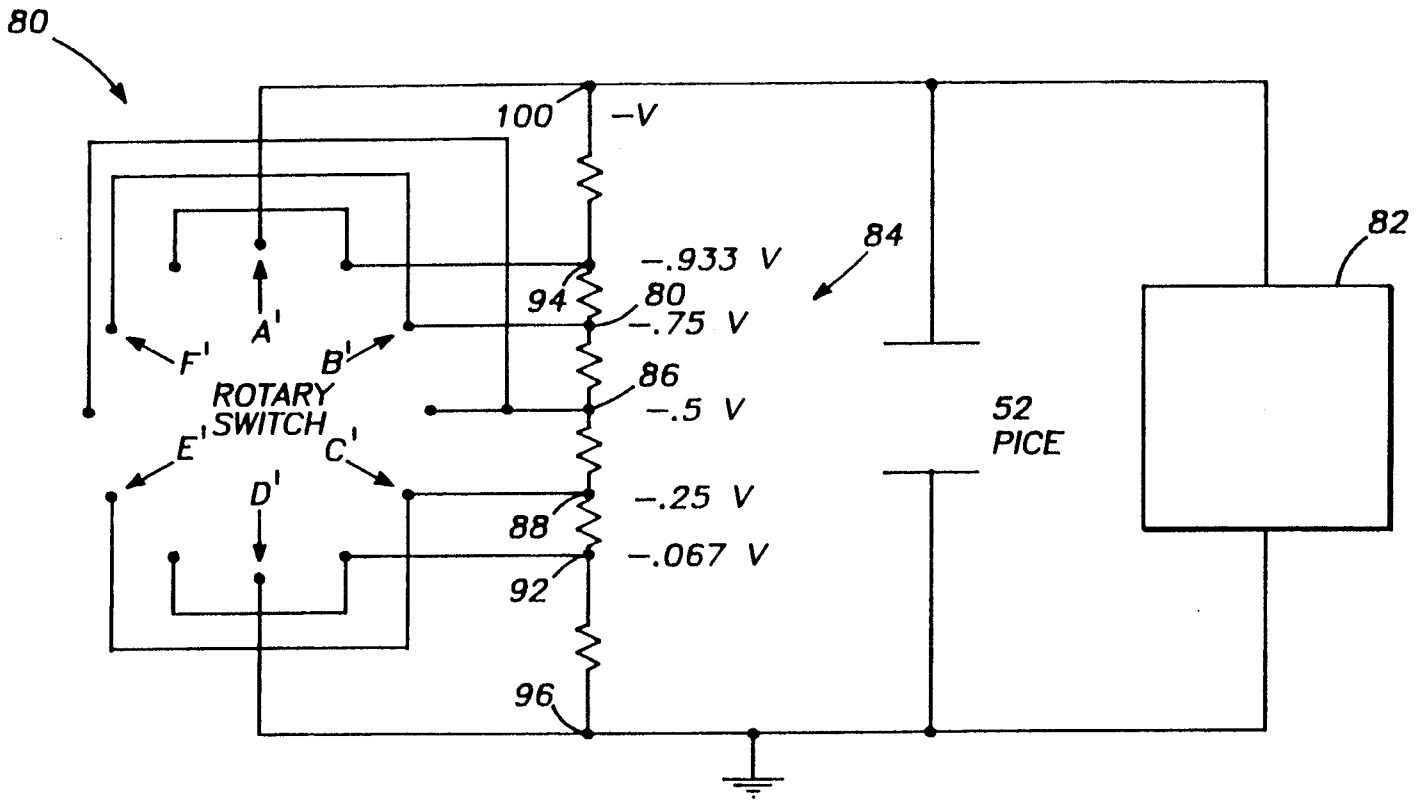
Figure 6A:
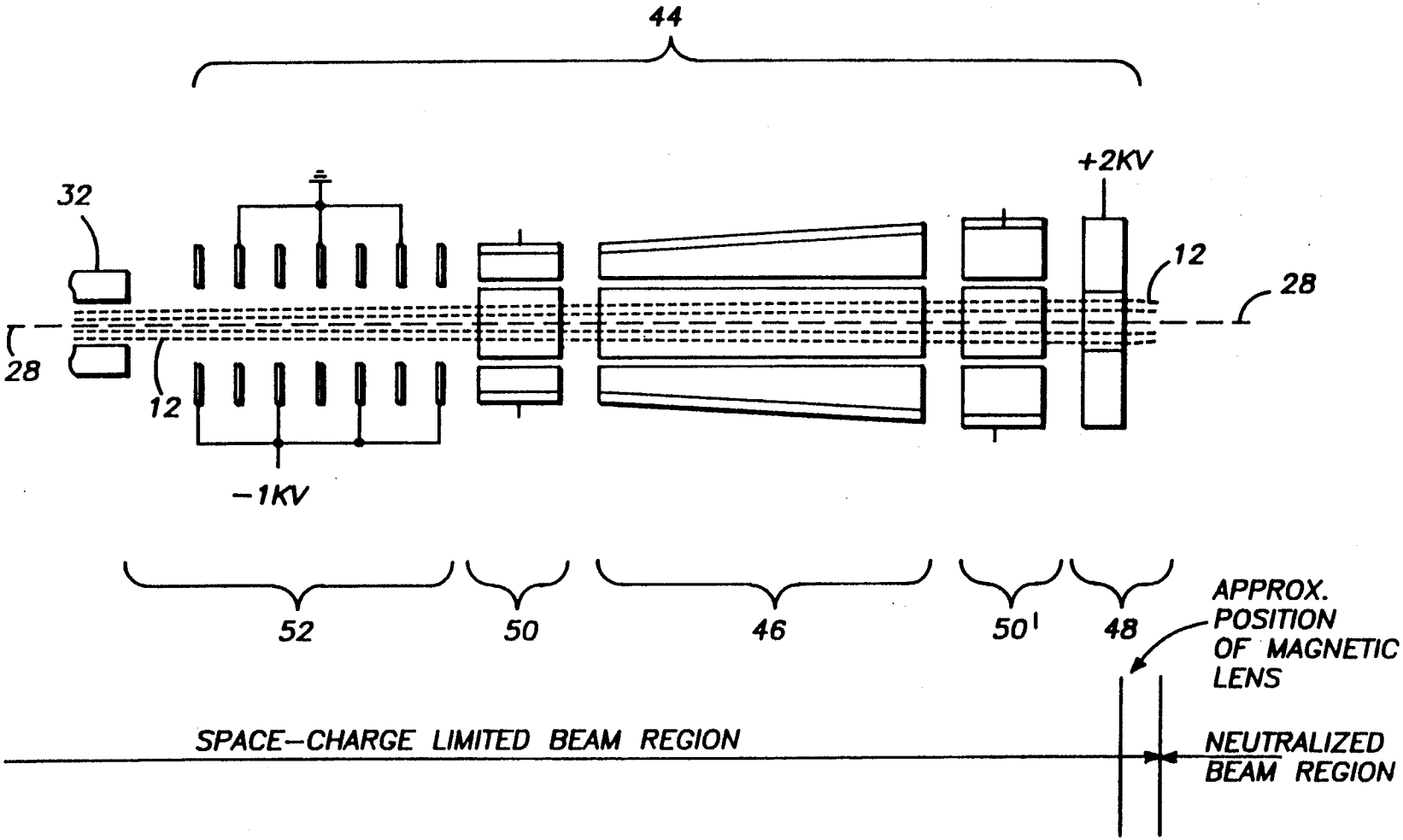
FIG. 6A is a longitudinal cross-sectional view of the electrode assembly 44 depicted in FIG. 3.
Figure 6B:
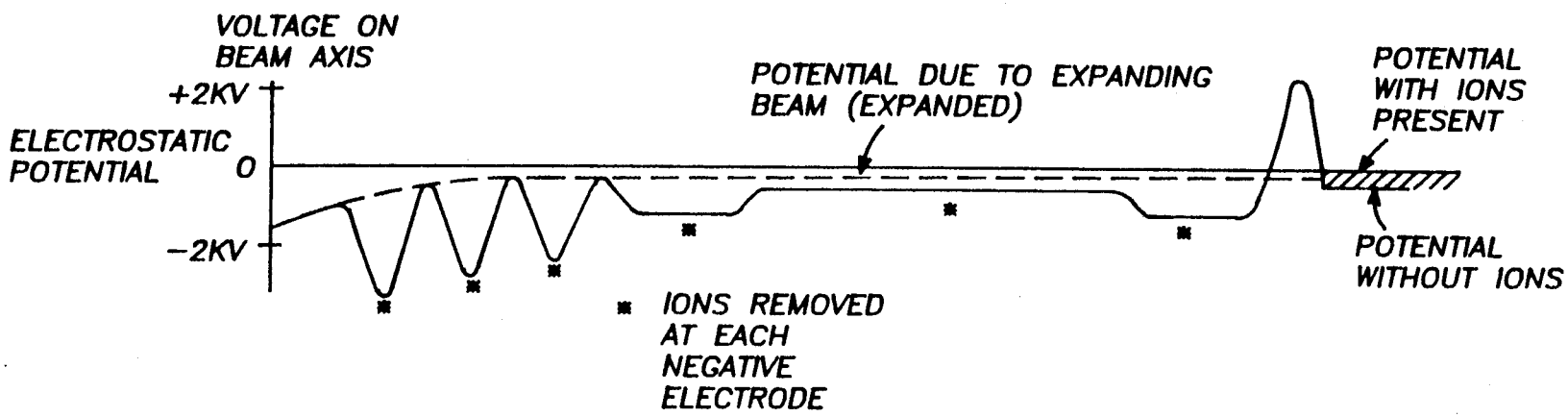
FIGS. 6B–6D depict electrostatic potential, transverse electric field and axial electric field at various longitudinal positions along assembly 44.
Figure 6C:
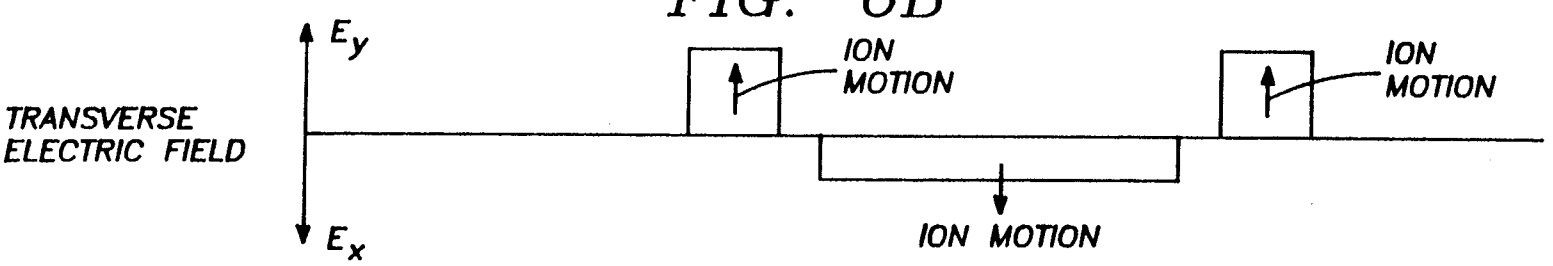
Figure 6D:
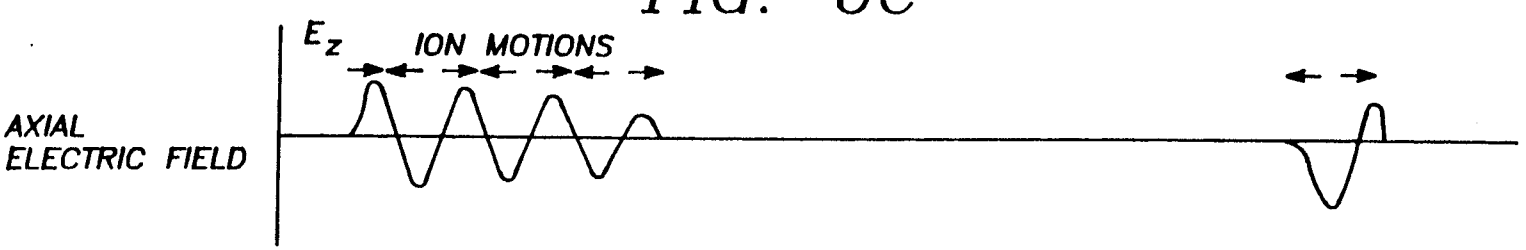

As shown in FIGS. 5A and 5B, preferably corresponding ICE 50, 50′ elements are electrically coupled to each other, and together electrically coupled to a RICE 46 element that is relatively 180° displaced. Thus, ICE elements 69A, 69A′ and opposite RICE element 59B are electrically coupled together, the collective lead denoted as A. Similarly, other corresponding ICE elements are coupled to an opposite RICE element, with the collective leads denoted B, C, D, E and F. Thus applying a voltage to, say, lead A will couple the voltage, be it AC, DC or a combination thereof, to ICE elements 69A, 69A′ and opposite RICE element 59B. According to the present invention, preferably an equal and opposite potential, with respect to the average potential, will be present on lead D, which opposing potential is electrically coupled to ICE electrodes 69B, 69B′ and opposite RICE electrode 59A.

As further depicted in FIGS. 5A and 5B, preferably the collective leads A, B, C, D, E and F are coupled to diametrically opposed rotary arms A′, B′, C′, D′, E′ and F′ on a rotary switch 80. Arms A′, B′, C′, D′, E′ and F′ rotate clockwise or counterclockwise in unison. A power source 82 is coupled to a voltage divider 84, preferably a series-connected resistor chain. If power source 82 outputs, say, −V, node 86 in the voltage divider will see −0.5V, a potential that may be considered as a relative reference point. Thus, nodes 88 and 90 will see −0.25V and −0.75V, or relative to reference node 86, +0.25V and −0.25V respectively. Similarly nodes 92 and 94 see −0.067V and −0.933V or, relative to node 86, +0.433V and −0.433V, while nodes 96 and 100 see 0 and −V, or relative to node 86, +0.5V and −0.5V respectively. Those skilled in the art will recognize that if desired, the relative magnitude of the potentials applied, for example, to ICE 50 and ICE 50′ elements could be scaled using resistors relative to the potentials applied to RICE 48.

Thus as the rotary arm in switch 80 is rotated clockwise, the potential seen by ICE elements 69A, 69A′ and RICE element 59B will increase (relative to node 86) by 0.067V, and the potential seen by the oppositely disposed ICE elements 69B, 69B′ and RICE element 59A will decrease (relative to node 86) by 0.067V. At the same time, the relative potential seen by ICE elements 70B, 70B′ and RICE element 60A will increase by 0.25V, while the relative potential seen by the oppositely disposed ICE elements 70A, 70A′ and RICE element 60B will decrease by 0.25V. The potential coupled to the other ICE and RICE electrodes is varied in similar fashion. Subject to possible scaling, the potential applied to the ICE and RICE electrodes preferably will follow the equation:

$$V_i = V_y \times 0.5 \times (1 + \sin\theta_i)$$

wherein $\theta_i$ is the average angle of electrode i.

Thus where switch 80 has fixed switch contacts coupled to new potential levels every 30° (see FIG. 4), by simply rotating switch 80, the electric field in electrode assembly 44 may be rotated in discrete 30° intervals, using the single power supply 82. Further, because the ICE field orientations are opposite to the RICE field orientation, the deflections and displacements of the electron beam by the ICE 52, RICE 46 and ICE 50′ electrodes can be made to cancel. Collectively the ICE and RICE electrodes are sized to permit the strength of the RICE's electric field to be adjusted to control the uniformity of the beam space-charge density. At the same time, the ICEs' fields are sufficiently high to completely remove positive ions from the beam, while maintaining a uniform electric field. Negative potential power source 82 and a positive, typically 2 kV power source required by PIE 48 are the only power sources required by electrode assembly 44 according to the preferred embodiment.

Returning to FIG. 3, preferably assembly 44 includes a positive ion electrode ("PIE") 48, disposed coaxially downstream from the RICE 46. The PIE 48 is preferably a planar washer whose center opening is at least as large as the beam diameter at that region, typically about 1.5 cm. PIE 48 is preferably coupled to a large positive potential (e.g., +2 kV) $V_{48}$. The resultant large axial PIE field prevents positive ions from migrating upstream toward and into the RICE. Such upstream migration would be detrimental and could interfere with the production of a sharply self-focused uniform beam at the X-ray target. A PIE 48 according to the present invention also serves to sharply define where the downstream field effects created by assembly 44 terminate.

Finally, as depicted in FIG. 3, preferably a periodic axial field ion clearing electrode, PICE 52, is disposed within the upstream end of assembly 44, adjacent the electron gun 32. The PICE 52 preferably comprises a plurality of disk-like elements 70, 72 spaced apart coaxially along the Z-axis 28. Alternate electrodes, e.g., 70, 70A, 70B, 70C are together coupled to a first potential source $V_{70}$ and the intermediate electrodes, e.g., 72, 72A, 72B are together coupled to a second potential source $V_{72}$.

In the preferred embodiment of FIG. 3, seven disks are used, and $V_{70} \approx -1$ kV and $V_{72} \approx 0$V (e.g., ground), although other potentials could be used. If desired, $V_{70}$ may be provided by coupling to the power source 82 used to provide the ICE and RICE element potentials (see FIG. 5). A design consideration for the PICE is that within a relatively short lateral distance, e.g., about 5 cm, a sufficiently high rate of change of axial potential must be created to rapidly remove ions. The potentials $V_{70}$, $V_{72}$, like the potentials coupled to the RICE 46, PIE 48, and ICEs 50, 50', are sufficient to create the desired field but, relative to the −130 kV electron gun potential, are not sufficient to disturb the electron beam flow.

FIGS. 6A–6D depict assembly 44 in longitudinal cross-section, and the fields created by the RICE 46, PIE 48, ICEs 50, 50' and PICE 52.

Modifications and variations may be made to the disclosed embodiments without departing from the subject and spirit of the invention as defined by the following claims. For example, although an ion controlling electrode assembly has been described with reference to a beam scanning computed tomography X-ray system, the present invention may also be used in other environments where it is necessary to produce a more homogenized electron beam space-charge density within a given region.

What is claimed is:

1. In a computed tomography X-ray scanning system, an electrode assembly for correcting space-charge density non-uniformity in an electron beam generated in a vacuum housing chamber containing a low pressure gas from which positive ions may be created, the electron beam traveling in a downstream direction defining a Z-axis, the assembly being disposed substantially coaxially with the electron beam along the Z-axis and comprising:

a rotatable field ion clearing electrode assembly including first, second and third electrode pairs, each said electrode pair comprising two electrode members spaced-apart diametrically relative to the Z-axis;

a power source providing a first potential level;

a voltage divider including divider nodes coupled to said single power source;

said divider providing at a first node a potential equal to said first potential level, providing at a last node a potential equal to ground, and providing at nodes intermediate to said first and last nodes potential levels intermediate to said first potential level and ground;

switch means for switchably coupling said electrode members to chosen ones of said divider nodes to create a potential difference between said members comprising each said electrode pair;

said rotatable field ion clearing electrode assembly producing an field controllably rotated by said switch means to an orientation controllably removing sufficient positive ions to compensate for space-charge density non-uniformity in said beam.

2. The assembly of claim 1, wherein said switch means couples substantially equally and opposite potentials, with respect to an average potential, to each said electrode member comprising a said electrode pair.

3. The assembly of claim 1, wherein relative to said Z-axis each said electrode member defines a mean radius R, and said beam defines a radius $r_o$, where a ratio defined by $R/r_o$ is substantially constant;

said $R/r_o$ ratio substantially eliminating a voltage gradient along said Z-axis, minimizing positive ion migration and attendant non-uniform space-charge distribution in said beam.

4. The assembly of claim 1, wherein said electrode members comprising each said electrode pair are substantially symmetrical about said Z-axis to each other.

5. The assembly of claim 1, wherein in cross-section said assembly defines a regular polygon.

6. The assembly of claim 1, wherein said switch means couples a potential $V_i$ to each electrode member in said assembly according to the equation:

$$V_i = V_y \times 0.5 \times (1 + \sin\theta_i) \quad (1)$$

where $\theta_i$ is the average angle of member i, $V_y$ represents the potential applied at an extreme Y-axis member position, and said Y-axis is orthogonal to said Z-axis.

7. The assembly of claim 1, wherein said electrode members are planar.

8. The assembly of claim 1, further including a first ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby.

9. The assembly of claim 8, further including a second ion clearing electrode disposed on a side of said rotatable ion clearing electrode opposite to said first ion clearing electrode, said second ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby;

wherein an electron beam traversing said electrode assembly experiences deflections and displacements that substantially cancel such that said beam emerges from said electrode assembly on said Z-axis.

10. The assembly of claim 1, further including:

a planar disk element defining a central opening sized to permit passage of said beam therethrough, disposed coaxial with said Z-axis downstream from said assembly; and means for coupling said planar disk to a source of positive potential sufficient to create an axial field blocking upstream migration of positive ions toward said assembly.

11. The assembly of claim 1, further including:

a plurality of planar disk elements, each defining a central opening sized to permit passage of said beam therethrough, spaced-apart and disposed coaxial with said Z-axis upstream from said assembly;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

12. In a computed tomography X-ray scanning system, an electrode assembly for correcting space-charge density non-uniformity in an electron beam generated in a vacuum housing chamber containing a low pressure gas from which positive ions may be created, the electron beam traveling in a downstream direction defining a Z-axis, the assembly being disposed substantially coaxially with the electron beam along the Z-axis and comprising:

a rotatable field ion clearing electrode assembly including at least three pairs of electrodes, each said electrode pair comprising two electrode members spaced-apart symmetrically and diametrically relative to the Z-axis, said rotatable ion clearing electrode assembly forming a regular polygon in cross-section;

a power source providing a first potential level;

a voltage divider including divider nodes coupled to said single power source;

said divider providing at a first node a potential equal to said first potential level, providing at a last node a potential equal to ground, and providing at nodes intermediate to said first and last nodes potential levels intermediate to said first potential level and ground;

switch means for switchably coupling said electrode members to chosen ones of said divider nodes to create a potential difference between said members comprising each said electrode pair causing each said electrode pair to create an electric field;

said switch means coupling a potential $V_i$ to each electrode member in said assembly according to the equation:

$$V_i = V_y \times 0.5 \times (1 + \sin\theta_i) \quad (1)$$

where $\theta_i$ is the average angle of member i, $V_y$ represents the potential applied at an extreme Y-axis member position, and said Y-axis is orthogonal to said Z-axis;

wherein relative to said Z-axis, the electron beam defines a radius $r_o$ and each said electrode pair defines a radial distance R, such that a ratio defined by $R/r_o$ is substantially constant eliminating any voltage gradient along said Z-axis such that positive ions within said rotatable ion electrode assembly will not migrate along said Z-axis;

said rotatable field ion clearing electrode assembly producing an electric field controllably rotated by said switch means to an orientation controllably removing sufficient positive ions to compensate for space-charge density non-uniformity in said beam and permit said electron beam to focus sharply upon a desired target.

13. The assembly of claim 12, wherein said electrode pairs are planar.

14. The assembly of claim 12, further including a first ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby.

15. The assembly of claim 14, further including a second ion clearing electrode disposed on a side of said rotatable ion clearing electrode opposite to said first ion clearing electrode, said second ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby;

wherein an electron beam traversing said electrode assembly experiences deflections and displacements that substantially cancel such that said beam emerges from said electrode assembly on said Z-axis.

16. The assembly of claim 12, further including:

a planar disk element defining a central opening sized to permit passage of said beam therethrough, disposed coaxial with said Z-axis downstream from said assembly; and means for coupling said planar disk to a source of positive potential sufficient to create an axial field blocking upstream migration of positive ions toward said assembly.

17. The assembly of claim 12, further including:

a plurality of planar disk elements, each defining a central opening sized to permit passage of said beam therethrough, spaced-apart and disposed coaxial with said Z-axis upstream from said assembly;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

18. In a computed tomography X-ray scanning system, an electron beam production and control system for producing X-rays, said system comprising:

an evacuated housing chamber having an upstream end, a downstream end, and defining a Z-axis extending therebetween, and further containing a low pressure gas from which positive ions may be created;

means, disposed within said upstream end of said chamber, for producing an electron beam and directing said beam in a downstream direction at least initially along said Z-axis;

means for correcting space-charge density non-uniformity of said electron beam by subjecting at least a portion of said electron beam to a rotatable electric field that controllably removes positive ions, said means being disposed substantially coaxially with said electron beam along said Z-axis and being powered by a single power source;

a stationary target, disposed within the downstream end of said chamber for emitting X-rays upon impingement by said electron beam;

means for deflecting and focusing said electron beam upon said target;

wherein said means for correcting promotes production of a more sharply focused electron beam upon said target than if said means for correction were not used.

19. The system of claim 18, wherein said upstream end of said chamber and said means for deflecting and focusing are separated by less than about 50 cm.

20. The system of claim 18, wherein said means for correcting includes:

a rotatable field ion clearing electrode assembly including at least three pairs of electrodes, each said electrode pair comprising two electrode members spaced-apart symmetrically and diametrically relative to the Z-axis, said rotatable ion clearing electrode assembly forming a regular polygon in cross-section;

a voltage divider including divider nodes coupled to said single power source;

said divider providing at a first node a potential equal to said first potential level, providing at a last node a potential equal to ground, and providing at nodes intermediate to said first and last nodes potential levels intermediate to said first potential level and ground;

switch means for switchably coupling said electrode members to chosen ones of said divider nodes to create a potential difference between said members comprising each said electrode pair;

said switch means coupling a potential $V_i$ to each electrode member in said assembly according to the equation:

$$V_i = V_y \times 0.5 \times (1 + \sin\theta_i) \quad (1)$$

where $\theta_i$ is the average angle of member i, $V_y$ represents the potential applied at an extreme Y-axis member position, and said Y-axis is orthogonal to said Z-axis;

wherein relative to said Z-axis, the electron beam defines a radius $r_o$ and each said electrode pair defines a radial distance R, such that a ratio defined by $R/r_o$ is substantially constant eliminating any voltage gradient along said Z-axis such that positive ions within said rotatable ion electrode assembly will not migrate along said Z-axis;

said rotatable ion clearing electrode assembly producing an electric field controllably rotated by said switch means to an orientation controllably removing sufficient positive ions to compensate for space-charge density non-uniformity in said beam and permit said electron beam to focus sharply upon a desired target.

21. The system of claim 18, further including a first ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby.

22. The system of claim 21, further including a second ion clearing electrode disposed on a side of said rotatable ion clearing electrode opposite to said first ion clearing electrode, said second ion clearing electrode comprising:

first, second and third electrode pairs, each said electrode pair comprising two electrode members spaced-apart diametrically and symmetrically relative to the Z-axis, said ion clearing electrode having a constant average radius from said Z-axis;

each said electrode member in said ion clearing electrode being electrically coupled to a said electrode member in said rotatable ion clearing electrode having a average angle $\theta 180°$ removed from said electrode member;

wherein said electrode pairs in said ion clearing electrode establish a substantially uniform electric field while sweeping away positive ions created therein or nearby;

wherein an electron beam traversing said electrode assembly experiences deflections and displacements that substantially cancel such that said beam emerges from said electrode assembly on said Z-axis.

23. The system of claim 18, further including:

a planar disk element defining a central opening sized to permit passage of said beam therethrough, disposed coaxial with said Z-axis downstream from said assembly; and means for coupling said planar disk to a source of positive potential sufficient to create an axial field blocking upstream migration of positive ions toward said assembly.

24. The system of claim 18, further including:

a plurality of planar disk elements, each defining a central opening sized to permit passage of said beam therethrough, spaced-apart and disposed coaxial with said Z-axis upstream from said assembly;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

* * * * *